US005713079A

United States Patent [19]

Simon et al.

[11] Patent Number: 5,713,079

[45] Date of Patent: Feb. 3, 1998

[54] DUAL INSULATION GARMENT

[75] Inventors: William Simon, Buron; Eric Rice, Oakland, both of Calif.

[73] Assignee: The North Face, Inc., San Leandro, Calif.

[21] Appl. No.: 755,079

[22] Filed: Nov. 22, 1996

[51] Int. Cl.[6] ..... A41D 3/02; A41D 27/02

[52] U.S. Cl. ..... 2/243.1; 2/93; 2/97; 2/272; 2/69

[58] Field of Search ..... 2/97, 87, 243.1, 2/272, 69.5, 69, 267, 268, 108, 85, 93; 112/402, 405, 439, 440, 404, 420; 428/68, 71, 72, 74, 76, 102, 6, 220

[56] References Cited

U.S. PATENT DOCUMENTS

| | | | |
|---|---|---|---|
| 1,355,177 | 10/1920 | Sollen | 2/97 |
| 1,569,955 | 1/1926 | Falter | 428/102 |
| 2,222,782 | 11/1940 | Moses | 112/420 |
| 2,379,416 | 7/1945 | Clark . | |
| 2,831,198 | 4/1958 | Datlof | 112/420 |
| 2,976,539 | 3/1961 | Brown, Jr. | 2/93 |
| 3,541,620 | 11/1970 | Chapuis | 2/272 |
| 3,584,323 | 6/1971 | Worley | 2/69.5 |
| 3,639,931 | 2/1972 | McGuire . | |
| 3,837,021 | 9/1974 | Sellers et al. | 112/420 |
| 3,839,756 | 10/1974 | Hibbert et al. . | |
| 3,959,834 | 6/1976 | Hunt . | |
| 4,248,927 | 2/1981 | Liebman . | |
| 4,354,281 | 10/1982 | Satoh . | |
| 4,502,153 | 3/1985 | Lapedes et al. | 2/97 |
| 4,507,806 | 4/1985 | Coombs | 2/97 |
| 4,583,247 | 4/1986 | Fingerhut et al. | 2/272 |
| 4,884,303 | 12/1989 | Scherer . | |
| 4,888,828 | 12/1989 | Tatsuno | 2/69.5 |
| 5,408,700 | 4/1995 | Reuben et al. | 2/97 |

FOREIGN PATENT DOCUMENTS

| | | | |
|---|---|---|---|
| 938781 | 1/1956 | Germany | 2/97 |
| 27 12 336 | 9/1978 | Germany . | |
| 297634 | 9/1928 | United Kingdom | 2/93 |
| 782708 | 9/1957 | United Kingdom | 2/97 |

*Primary Examiner*—Amy B. Vanatta
*Attorney, Agent, or Firm*—Malcolm B. Wittenberg

[57] ABSTRACT

An insulated garment which includes an outer fabric and an inner fabric and at least two layers of insulation between the inner and outer fabrics. A first layer of insulation contiguous to the outer fabric is a synthetic material and a second layer of insulation contiguous to the inner fabric is goose down. Stitching maintaining the inner and outer fabrics to the two layers of insulation is patterned so that the stitching of one of the layers of insulation is contiguous to mid-points between the stitching of the second layer of insulation.

6 Claims, 1 Drawing Sheet

DUAL INSULATION GARMENT

TECHNICAL FIELD OF THE INVENTION

The present invention deals with an insulated garment uniquely configured to provide the user with maximum insulation. It is contemplated that the present invention will provide a user with the maximum degree of insulation for a given weight of garment. The invention is particularly applicable to situations in which a user is anticipated to be engaged in active outdoor pursuits in climates where extreme cold conditions are anticipated.

BACKGROUND OF THE INVENTION

Those engaged in active outdoor pursuits such as skiing, mountain and ice climbing are quite familiar with the typical insulated garments which are currently available. Such garments, for example, in the form of ski jackets, are constructed with an outer shell of nylon or other synthetic which is somewhat resistant to water penetration and an inner fabric which can be nylon, polyester or other absorbent and insulation located between the recited outer and inner fabrics. The type and quantity of insulation is generally dictated by the severity of climactic weather conditions being anticipated. In addition, certain fabrics are rated as having a higher insulation value per given weight of material. As such, where bulk and weight are important to the end user, certain insulators are dictated over others.

It has long been appreciated that goose down is an excellent insulator as goose down is light in weight and exhibits significant heat insulating properties. However, goose down is not ideal as it has been recognized that this insulator tends to bunch up within a garment often adversely affecting its heat insulating properties. In addition, goose down is highly moisture absorbent. When wet, the volume of goose down is significantly reduced and there is a tendency of goose down to bunch up in a garment. Once this occurs, it is virtually impossible to restore the goose down to its originally configured uniform layered structure.

By contrast, synthetic insulators such as Polarguard 3D™, a continuous filament polyester sold by Hoechst Celanese, can be used herein and which, for the most part, do not suffer the same ill effects as goose down when wet. Oftentimes, synthetic insulators, once wet, can be simply dried and to a large extent, maintain their integrity within a suitable garment. However, most synthetic insulators do not have the desired feel of down and do not provide the equivalent insulation value per unit weight which characterizes down as such an excellent insulator.

It is also known that once an insulator has been placed within a garment, the inner and outer layers of fabric must be quilted with the insulator to maintain the overall integrity of the structure. This quilting operation, in effect, clamps the insulating layers against displacement within the garment structure. However, it has been found that such quilting significantly reduces the effectiveness of the insulation as the ability to maintain a high heat gradient across the sidewall of the garment is reduced where lines of stitching appear.

It is thus an object of the present invention to provide a garment having the beneficial effects of goose down and of synthetic insulation while avoiding the drawbacks inherent in prior garments as discussed above.

This and further objects will be more readily apparent when considering the following disclosure and appended drawing.

BRIEF DESCRIPTION OF THE DRAWINGS

The sole drawing is a partial cutaway view of a portion of a garment, in the form of a jacket, in perspective, showing the insulating/lining fabrics which constitute the present invention.

SUMMARY OF THE INVENTION

Figure 1:
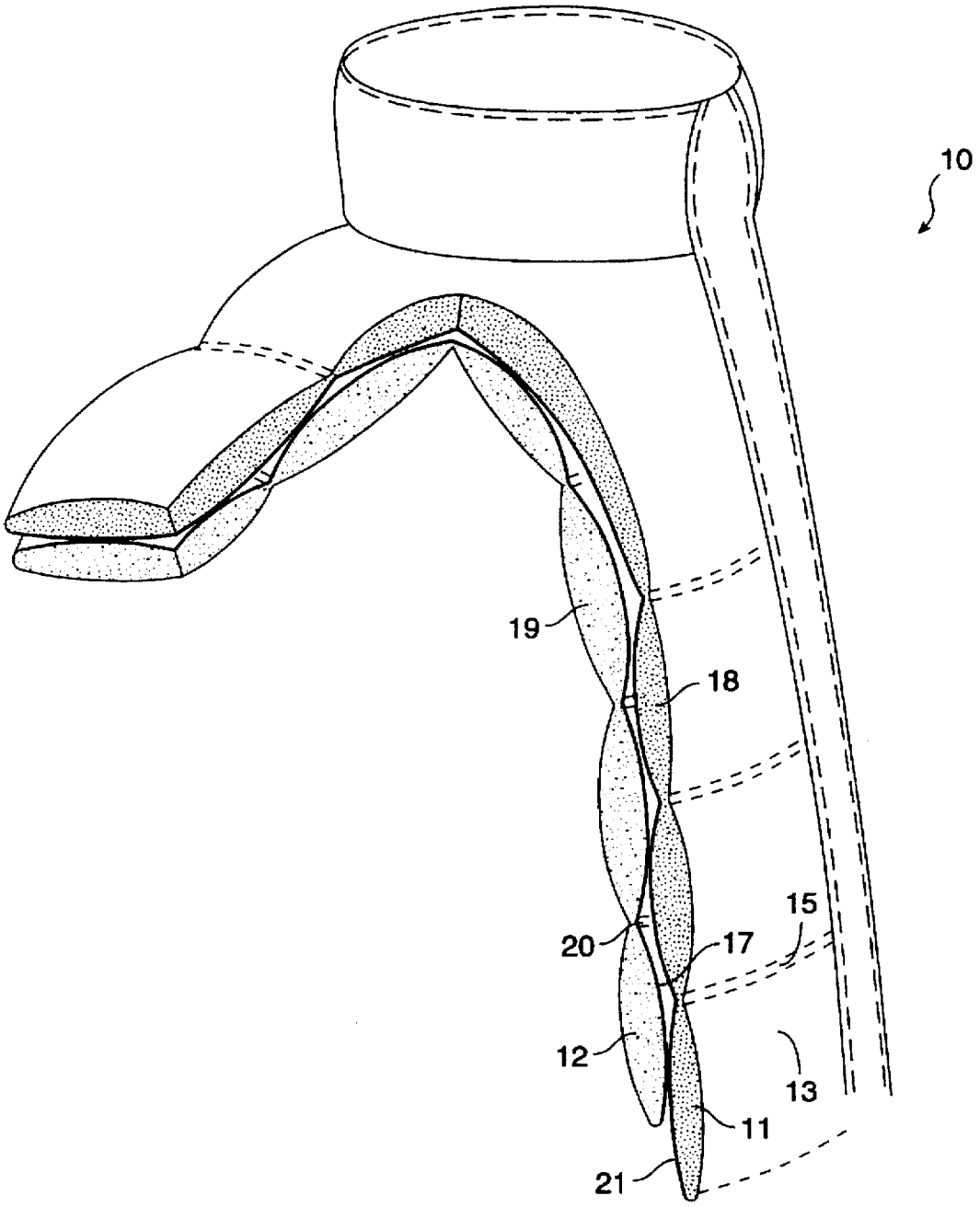

The present invention is directed to an insulated garment comprising an outer fabric and an inner fabric and at least two layers of insulation between the inner and outer fabrics. The first layer of insulation is located contiguous to the outer fabric and comprises synthetic material. A second layer of insulation is located contiguous to the inner fabric and is comprised of goose down.

The first layer of insulated fabric is provided with a regular array of stitching attaching it to the outer fabric forming a series of first insulation panels. Similarly, the second layer of insulation is provided with a regular array of stitching attaching it to the inner fabric, again forming a series of second insulation panels. As such, the first and second insulation panels are characterized as having borders formed by the regular array of stitching and mid-points located approximately equidistant between these borders. The insulating garments are further characterized such that borders of one of the layers of insulation are located proximate the mid-points of the panels of the other layers of insulation.

DETAILED DESCRIPTION OF THE INVENTION

Turning to the sole FIGURE of the present application, garment 10 in the form of a jacket is shown with a portion of the body and shoulder section of the garment cut away so that the present invention can be more readily visualized. As noted, the garment is provided with outer fabric 13 and inner fabric 14, the outer fabric being in the form of a water-resistant cloth of synthetic resin fibers or any one member selected from the group consisting of nylon and polyester. Inner fabric 14 can be 210T nylon taffeta or any member selected from the group consisting of nylons and polyesters.

As noted previously, although goose down provides excellent insulating qualities, it is adversely affected by moisture. As such, the present invention contemplates employing at least two layers of insulation between inner and outer fabrics 13 and 14, the first layer of insulation 11 being a synthetic and, preferably, being composed of a member selected from the group consisting of nylon and polyester while the second layer of insulation 12, being contiguous to inner fabric 14 is comprised of goose down.

As noted, first layer of insulation 11 is provided with a regular array of stitching 15 attaching first layer of insulation 11 to outer fabric 13. As a preferred embodiment, stitching 15 can also attach first layer of insulation 11 to interlining fabric 21. Similarly, second layer of insulation 12 is provided with a regular array of stitching 20 attaching the second layer of insulation to inner fabric 14. Stitching 20 can also attach inner fabric 14 to a second interlining fabric 17 as shown in the appended FIGURE.

By creating stitching 15 between outer fabric 13 and interlining fabric 21 and by creating stitching pattern 20 connecting inner fabric 14 to interlining fabric 17, a series of insulation panels are created having borders defined by the various stitching arrays and mid-points 18 and 19, respectively. The placement of these various borders and mid-points between contiguous insulation panels is an important consideration in practicing the present invention. As noted previously, in regions were stitching has been carried out, the insulating effect of the garment is greatly compromised. The reason for this is that insulation in the vicinity of stitching reduces the cross-sectional width of the insulation and actually causes puncture holes to pass through the fabric and insulation resulting in a dramatically reduced insulation factor. As such, in practicing the present invention, it is important that the borders as defined by the various stitching patterns 15 and 20 are located proximate mid-points of the panels of the other layers of insulation at 18 and 19. As such, weak points in insulation of one layer are contiguous to or abut an adjacent insulating layer at its greatest point of insulation.

We claim:

1. An insulated garment comprising an outer fabric and an inner fabric and at least two layers of insulation between said inner and outer fabrics, the first layer of insulation being located contiguous to said outer fabric comprising a synthetic material and a second layer of insulation being located contiguous to said inner fabric comprising goose down, said first layer of insulation having a regular array of stitching attaching said first layer of insulation to said outer fabric forming a series of first insulation panels and said second layer of insulation having a regular array of stitching attaching said second layer of insulation to said inner fabric forming a series of second insulation panels, said first and second insulation panels having borders formed by said regular array of stitching and mid-points being located approximately equidistant between said borders, said insulated garment being characterized such that borders of one of the layers of insulation are located proximate the mid-points of the panels of the other of the layers of insulation.

2. The garment of claim 1 further comprising an interlining fabric located between said first and second layers of insulation.

3. The garment of claim 1 wherein said synthetic material comprises a member selected from the group consisting of nylons and polyesters.

4. The garment of claim 1 wherein said outer fabric is substantially resistant to the passage of water.

5. The garment of claim 4 wherein said outer fabric comprises a member selected from the group consisting of nylons and polyesters.

6. The garment of claim 1 further comprising a first interlining fabric being contiguous to said first layer of insulation and being stitched to said outer fabric through said first layer of insulation and a second interlining fabric being contiguous to said second layer of insulation and being stitched to said inner fabric through said second layer of insulation.

* * * * *